US005676474A

United States Patent [19]

Doi

[11] Patent Number: 5,676,474

[45] Date of Patent: Oct. 14, 1997

[54] PRINT ACTUATOR

[75] Inventor: Norio Doi, Yokohama, Japan

[73] Assignee: International Business Machines Corporation, Armonk, N.Y.

[21] Appl. No.: 607,050

[22] Filed: Feb. 26, 1996

[30] Foreign Application Priority Data

Mar. 29, 1995 [JP] Japan ..... 7-071672

[51] Int. Cl.[6] ..... B41J 2/30

[52] U.S. Cl. ..... 400/124.04; 400/167

[58] Field of Search ..... 400/124.01, 120.11, 400/120.14, 120.17, 120.2, 120.21, 167, 124.04

[56] References Cited

U.S. PATENT DOCUMENTS

| | | | |
|---|---|---|---|
| 4,134,691 | 1/1979 | Matschke | 400/124.14 |
| 4,613,243 | 9/1986 | Rossi et al. | 400/167 |
| 4,995,744 | 2/1991 | Goldowsky et al. | 400/124.2 |
| 5,232,296 | 8/1993 | Andou et al. | 400/124.2 |

*Primary Examiner*—John S. Hilten
*Attorney, Agent, or Firm*—George E. Grosser

[57] ABSTRACT

Disclosed is a print actuator that maintains an adequate impact force and a shift stroke length and considerably increases a printing speed. According to the print actuator of the present invention, when a leaf spring 78 has been released from a rear magnetic unit 68 and passes through its neutral point and abuts upon magnetic poles 92 and 94 of a front magnetic unit 86, kinetic energy is stored in the leaf spring 78. By contacting the magnetic poles 92 and 94 of the front magnetic unit 86, the leaf spring 78 obtains a reaction force and generates kinetic energy for the return direction. The initial kinetic energy for an armature 80 is acquired from the composite force that consists of the reaction force and a recovery force that is stored in the leaf spring 78. The movement of the armature 80 is greatly accelerated by the attraction force of a permanent magnet 70 when no current is supplied to a coil 72, and is brought into contact with the magnetic poles 92, 94 and halted. That is, compared with the prior art, the initial speed of the armature 80 is considerably increased by the reaction force, and the time required for the return is substantially reduced.

1 Claim, 11 Drawing Sheets

ELECTRIFICATION TIMING FOR COIL 90
ON
OFF
t

CURRENT FLOWING ACROSS COIL 90
t

FRONT MAGNETIC UNIT 86 SIDE
ARMATURE POSITION
NEUTRAL POSITION
REAR MAGNETIC UNIT 68 SIDE
STANDBY POSITION
BLOCKING POSITION
PRIOR ART
t

ELECTRIFICATION TIMING FOR COIL 72
ON
OFF
t

CURRENT FLOWING ACROSS COIL 72
t

PRINT ACTUATOR

BACKGROUND OF THE INVENTION
TECHNICAL FIELD

The present invention relates to a print actuator, and in particular to an actuator that is preferably employed as a print head for a wire dot-matrix printer.

DESCRIPTION OF RELATED ART

A wire dot-matrix printer records pixels on a recording medium, such as paper, by causing the distal ends of printing wires to impact a platen through an intervening ink ribbon and the recording medium, and forms characters and graphic figures on the recording medium with the arrangement of pixels.

Since wire dot-matrix printers can make multiple copies simultaneously (print a plurality of overlapping sheets of paper), and can be made compactly and at a low cost, wire dot-matrix printers have been widely employed as output devices for the peripheral terminals of information processing systems, of office computers, and of personal computers.

In such a wire dot-matrix printer, the print head that drives printing wires is an important component that greatly affects the printing performance and the reliability of the wire dot-matrix printer. The most important requirements for a print head are that it have (1) a high printing speed, (2) a long shift stroke for printing wires, and (3) a strong impact force for the distal ends of the printing wires when they strike recording medium on a platen. Other requirements include a low electric power consumption, an excellent heat dissipation capability, a small external size, and a low manufacturing cost. The shift stroke and the impact force are important elements for the acquisition of a high print quality when the number of sheets that are used to produce simultaneous copies, such as for bills, is large (for example, 8 to 10 sheets), or when the thickness of a recorded medium is changed during the printing.

To meet the requirements, various proposals have been provided concerning the structure of a print head, especially, concerning the method that is used for driving printing wires.

In a print actuator that was disclosed by the present applicant in Japanese Unexamined Patent Publication No. Sho 61-244559, a stator is formed with a plurality of magnetic poles, and an armature that is supported by a leaf spring is so located that the line of the width extends across gaps between the magnetic poles.

A coil is wound around the stator. The print actuator electrifies the coil to excite the stator, which in turn attracts the armature to accumulate force in advance in the leaf spring. The shifting of the armature and the printing wire is performed by halting the current supply to the coil and the attraction of the armature.

The speed at which the printing wire and of the armature move corresponds to a resonance frequency of the leaf spring, and relies on a spring constant of the leaf spring. The spring constant of the leaf spring must be increased to improve the printing speed, and when this is done, the impact force of the printing wire can accordingly be increased (stored energy method).

Since the shifting stroke of the printing wire (and the armature) corresponds to the amplitude of the leaf spring, a large energy volume is required to increase the spring constant of the leaf spring and to obtain a greater shifting stroke distance. The electricity that is consumed and the volume of heat that is generated by a solenoid that is employed to displace the leaf spring is increased and the external size becomes larger, and in addition, a large scale power source for the driving circuit in the solenoid is required. A problem also arises with the manufacturing cost.

As is described above, it has been difficult to provide an improved printing speed, and a larger impact force, and an increase in the shifting stroke distance simultaneously.

To resolve these shortcomings, in Japanese Unexamined Patent Publication No. Hei 6-231946 is proposed a print actuator wherein magnetic units are provided at the respective ends of an armature in the shifting direction.

This print actuator is so designed that one of the magnetic units attracts the armature when the coil is not electrified, and the other magnetic unit attracts the armature when the coil is electrified.

With this structure, as the armature is attracted by one of the magnetic units while the coil is not electrified, energy is accumulated in the leaf spring. The coil of this magnetic unit is electrified, and at the same time the coil of the other magnetic unit is electrified, so that both the operation that is due to the discharge of the energy of the leaf spring and the operation that is due to the attraction force to the other act together to improve the flight time for printing (push and pull method).

According to the above described background (the stored energy method and the push and pull method), although the speed (flight time) at which the armature moves forward can be shortened, the speed (return time) at which the armature returns is not changed, and any improvement in the printing speed is limited.

SUMMARY OF THE INVENTION

To overcome the above described shortcoming, one aspect of the present invention is to provide a print actuator that can considerably increase printing speed while it maintains an adequate impact force and shifting stroke.

According to another aspect of the present invention, a print actuator comprises: a magnetic unit, which includes a pair of magnetic poles that are made of magnetic material and that are provided almost in parallel at a predetermined space and a permanent magnet that is located between the pair of magnetic poles and around which is wound by a coil; an armature, which is provided on one end of an elastic member that is supported at its other end by support means, which is moved by the permanent magnet against a force that is exerted by the elastic member and is attracted to a part of the magnetic unit when the coil is not electrified, and which is moved by a charged spring force of said elastic member being magnetically canceled when the coil is electrified and is released from a part of a stator by the force that is exerted by the elastic member; a printing element, which is coupled with the armature, for providing an impact force to a printing medium as the armature is shifted in a release direction; and a blocking member, for contacting the armature as the armature is shifted in the release direction and for restricting travel by the armature in the release direction, and for employing a reaction force when the blocking member contacts the armature so as to shift the armature in a direction in which the armature is attracted.

According to another aspect of the present invention, a gap between a blocking face of the blocking member and the armature is ⅓ to ⅔ of a stroke length from a neutral point when the armature is freely shifted after the armature has been released.

According to another aspect of the present invention, in a print actuator, a face of the blocking member that contacts the armature is inclined, and an elastic member attachment side of the armature is first brought into contact with the face of the blocking member to accumulate kinetic energy at a distal end of the armature to which the printing element is attached.

Further considering an implementation of the present invention, a print actuator comprises: a magnetic unit, which includes a pair of magnetic poles that are made of magnetic material and that are provided almost in parallel at a predetermined space and a permanent magnet that is located between the pair of magnetic poles and around which is wound by a first coil; an armature, which is provided on one end of an elastic member that is supported at an other end by support means, which is moved by the permanent magnet against a force that is exerted by the elastic member and is attracted to a part of the magnetic unit when the first coil is not electrified, and which is moved by a charged spring force of said elastic member being magnetically canceled when the coil is electrified and is released from a part of a magnetic unit by the force that is exerted by the elastic member; a printing element, which is coupled with the armature, for providing an impact force to a printing medium as the armature is shifted in a release direction; and a blocking magnetic unit, which includes a pair of magnetic poles that are made of magnetic material and that are provided almost in parallel at a predetermined space and around which a second coil is wound, for attracting the armature by electrifying the second coil at the same time as the armature is shifted in a release direction, for contacting the armature when the armature is shifted in the release direction for restricting travel by the armature in the release direction, and for employing a reaction force when the armature is contacted and therewith shifting the armature in a direction in which the armature is attracted.

According to our aspect of the present invention, in such a print actuator, a gap between a blocking face of the blocking magnetic unit and the armature is ⅓ to ⅔ of a stroke length from a neutral point when the armature is shifted freely after the armature has been released.

According to an aspect of the present invention, in such a print actuator, a face of the blocking magnetic unit that contacts the armature is inclined, and an elastic member attachment side of the armature is first brought into contact with the face of the blocking magnetic unit to accumulate kinetic energy at a distal end of the armature to which the printing element is attached.

According to another aspect of the present invention, the armature is attracted and is held at a part of a magnetic unit by the attraction force of a permanent magnet that acts against the force that is exerted by the elastic member.

When the printing element provides an impact force to the printing medium, the coil is electrified. When the coil has been electrified, the attraction force of the permanent magnet is canceled and the attraction of the armature is thus eliminated. Then, the armature is forcibly released by the charged force of the elastic member that has been built up (accumulated), and the printing element provides an impact force to the member to the printing medium.

The blocking member is located at a predetermined position in the direction in which the armature is released, and the armature abuts upon the blocking member before the stroke at which it is freely released. Therefore, a reaction force that is counter to the abutting force is generated, and an charged force that acts in the direction that is opposite to the release direction occurs by the armature passing through the charged force point (neutral point) of the elastic member. Further, this reaction force is added to the attraction force of the permanent magnetic, which results from the deelectrification of the coil, so that the armature is shifted in the direction in which it is attracted. Since an initial speed is increased because the reaction force is added, the shifting speed in the attraction direction (the return path of the armature) is increased, and as a result, the travel time that is required for one stroke of the armature can be shortened.

According to another aspect of the present invention, since the blocking face of the blocking member is positioned at ⅓ to ⅔ of the stroke length from the neutral point when the armature is freely shifted following its release, an impact force having a predetermined magnitude can be maintained and a large reaction force can be acquired also.

According to the present invention, since the face of the blocking member that contacts the armature is inclined, the side of the armature to which the elastic member is attached contacts the inclined blocking member face first, and then the side (the distal end) to which the printing element is attached contacts it. The kinetic energy is accumulated at the side that contacts later, and the shifting speed is increased by a so-called snapping action. The impact force of the printing element can therefore be increased.

According to an aspect of the present invention, since the second coil on the blocking magnetic unit is electrified at flight time, i.e., when the first coil is electrified, the speed of the armature is increased in impact direction movement. Therefore, the time required for one stroke following the actuation of the armature can be remarkably shortened.

According to an aspect of the present invention, since the blocking face of the blocking magnetic unit is positioned ⅓ to ⅔ of the stroke length from the neutral point when the armature is freely shifted following its release, a predetermined impact force can be maintained and a large reaction force can be acquired.

According to an aspect of the present invention, since the face of the blocking magnetic unit that contacts the armature is inclined, the side of the armature to which the elastic member is attached contacts the inclined blocking magnetic unit face first, and then the side (distal end) to which the printing element is attached contacts it. The kinetic energy is accumulated at the side that contacts later, and the shifting speed is increased by a so-called snapping action. The impact force of the printing element can therefore be increased.

DESCRIPTION OF A PREFERRED EMBODIMENT

Figure 1:
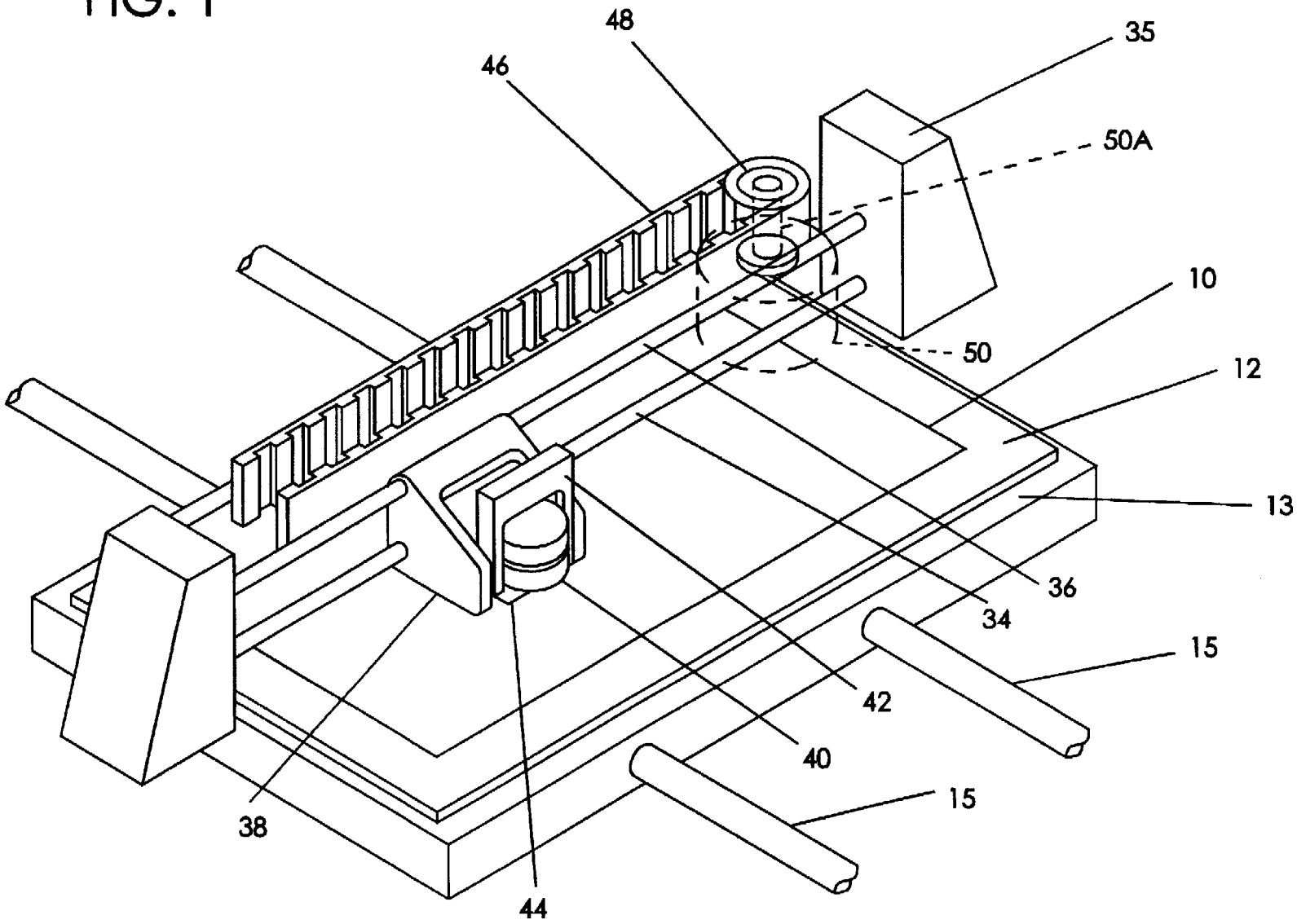
FIG. 1 is a perspective view of the essential portion of a wire dot-matrix printer according to one embodiment of the present invention.

One embodiment of the present invention will now be described while referring to the accompanying drawings. In FIG. 1 is shown the essential portion of a wire dot-matrix printer according to the embodiment of the present invention. The wire dot-matrix printer includes a platen 12 to which a recording medium 10, such as paper, is mounted. The platen 12 is a flat plate made of metal (e.g., iron) and mounted on a shift table 13. The shift table 13 is supported by a pair of shafts 15 that are positioned parallel to each other, and is shifted by a driving force exerted by a motor (not shown) in the axial direction of the shafts 15.

A pair of shafts 34 and 36 that are positioned parallel to each other are provided above the platen 12 and are supported by a pair of support pillars 35. A shift block 38 is fitted around the shafts 34 and 36 so as to be slidable in the longitudinal direction of the shafts 34 and 36. A print head 40 to which the present invention is applied is attached to the shift block 38. A printing wire is internally attached to the print head 40 so that it projects toward the platen 12, and during the printing the print wire protrudes from the print head 40. The structure of the print head 40 will be described in detail later.

An ink ribbon cartridge 42 engages the shift block 38. The ink ribbon cartridge 42 retains internally an endless ink ribbon 44 of which one part of it is exposed. The exposed portion of the ink ribbon 44 is so positioned that it is interposed between the distal end of the projected portion of the printing wire and the platen 12. When the printing wire is projected, therefore, the ink ribbon 44 is pressed against the platen 12 by the distal end of the printing wire, and dots are recorded on the recording medium 10 that is mounted on the platen 12. It should be noted that the ink ribbon cartridge 42 can be exchanged.

An endless belt 46 (partly shown) is located behind the shift block 38, which is fixed to a predetermined portion of the endless belt 46. The internal surface of the endless belt 46 has recessed and raised portions, and is wound around a pair of gears 48 (only one of them shown) that an external surface that has raised and recessed portions that correspond to the recessed and raised portions of the belt 46. The gear 48 is securely fixed to a drive shaft 50A of a motor 50. When the motor 50 is driven, the gears 48 and the endless belt 46 are rotated and the shift block 38 is slid along the shafts 34 and 36 (in the main scanning direction).

Figure 2:
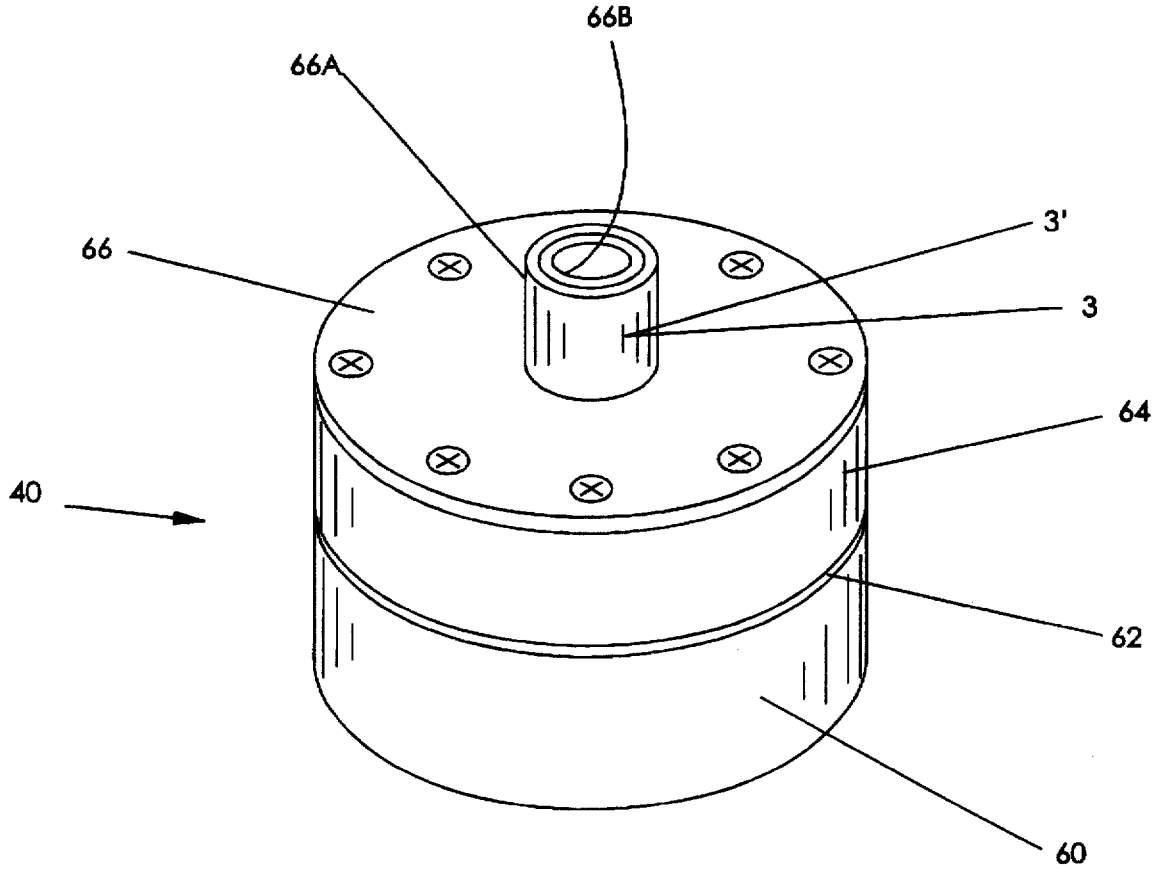
FIG. 2 is a perspective view of the outline of a print head.

The print head 40 will now be explained. As is shown in FIG. 2, the print head 40 is formed by stacking in order a cylindrical rear frame 60, a thin plate 62, a cylindrical front frame 64, and a disk front housing 66. The rear frame 60 and the front frame 64 are made of aluminum that has high heat dissipation capability. A cylindrical protrusion 66A that has a predetermined diameter is formed in the center of the front housing 66, and a circular hole 66B is bored in the center of the protrusion 66A along its diameter to extend through the shaft of the print head 40.

Figure 3:
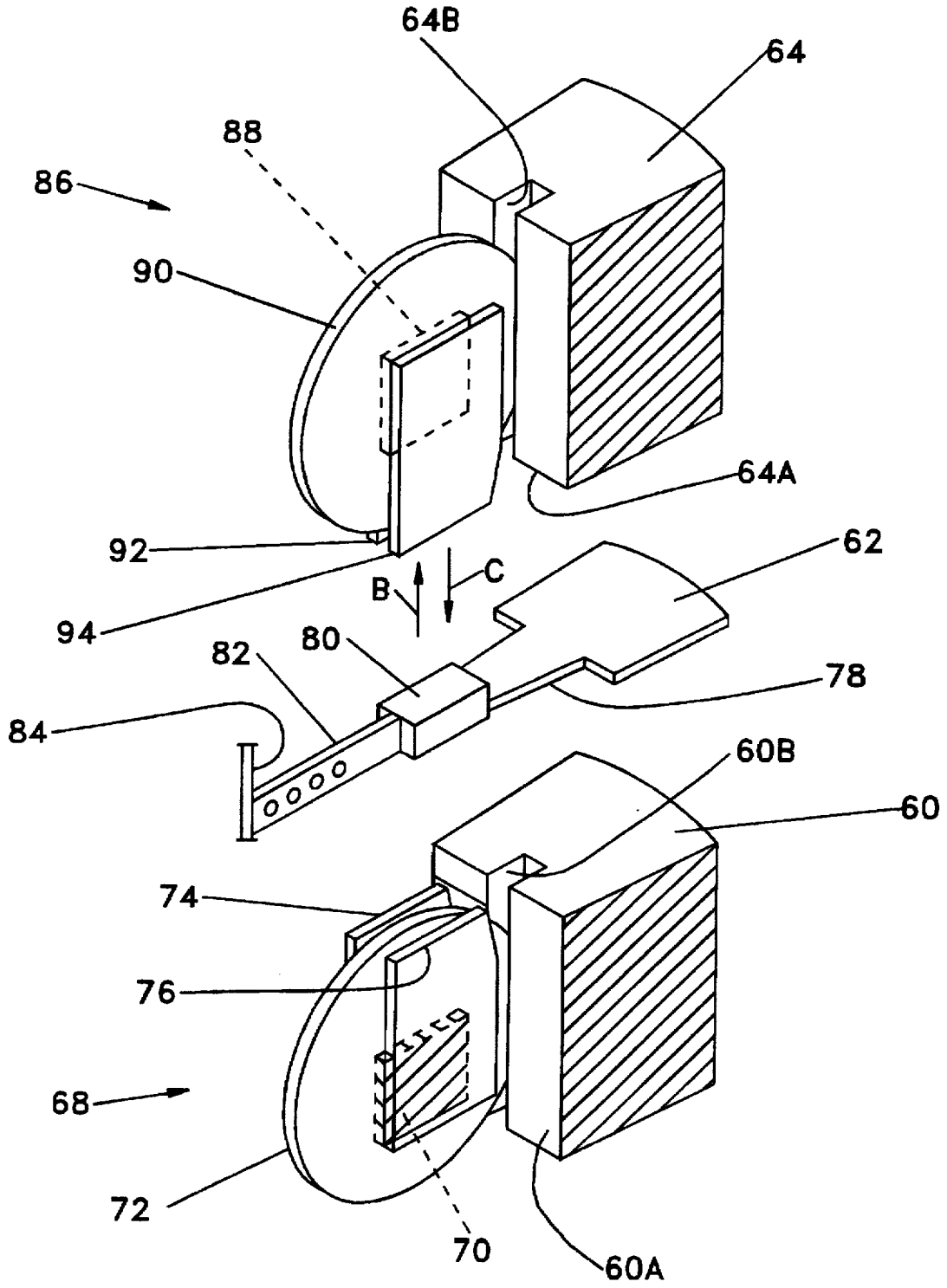
FIG. 3 is an exploded perspective view of the print head taken along the line 3—3' in FIG. 2.

As is shown in FIG. 3, a rear magnetic unit 68 is internally located on the side of the rear frame 60. Although only a single magnetic unit 68 is shown in FIG. 3, actually, multiple magnetic units 68 that have the same structure are provided as in a ring around the internal face of the rear frame 60. The magnetic unit 68 has a permanent magnetic plate 70. The two faces of the permanent magnet 70 that have the largest area and are opposite to each other are magnetized with different polarities, and the permanent magnet 70 is so positioned that the faces are located almost perpendicular to an internal wall 60A of the rear frame 60 and along the axis of the print head 40.

Aluminum spacers (not shown) are placed between adjacent multiple magnetic units 68, and support them. The face of the permanent magnet 70 of an magnetic unit 68 has the same polarity as that of the permanent magnet 70 of an adjacent magnetic unit 68, and by the effects produced together with the spacers, the occurrence of any undesirable effect due to magnetic interference between the adjacent magnetic units 68 is prevented.

A coil 72, the first coil, is so wound around the permanent magnet 70 that its axial direction is perpendicular to the face of the permanent magnet 70. A corresponding groove 60B is formed in the internal wall 60A of the rear frame 60 to store the coil 72. A pair of magnetic poles 74 and 76 are located on the sides of the permanent magnet 70 so that they are parallel to each other with the permanent magnet 70 in between. The magnetic poles 74 and 76 are made of magnetic material, and extend toward the plate 62 (upward in FIG. 3). The extended portions of the magnetic poles 74 and 76 face each other with a gap between them that corresponds to the size that is sufficient to retain the coil 72. In the magnetic unit 68, the permanent magnet 70 and the magnetic poles 74 and 76 constitute a stator.

The metal plate 62 is so formed that it is almost annular, and a protrusion 78 that projects toward the shaft center of the print head 40 is provided on its internal side. Although only a single protrusion 78 is shown in FIG. 3, actually, the protrusions 78, whose number equals the number of the magnetic units 68 in the rear frame 60, are arranged in the same shape and similar to a ring around the internal face of the plate 62. Since the plate 62 is made of thin metal, the protrusion 78 that is integrally formed with the plate 62 is accordingly elastic in the directions indicated by the arrows B and C in FIG. 3 in which it is deformed, and serves as a leaf spring (hereafter the protrusion 78 is referred to as a "leaf spring 78").

An armature 80 is fixed to the distal end of each of the leaf springs 78. The armature 80 is made of a material that has high permeability. The armature 80 is so located that, when the print head 40 is attached, the bottom face of the armature 80 in FIG. 3 corresponds to the distal ends of the magnetic poles 74 and 76, and its longitudinal center line crosses at a right angle the line in the direction in which the magnetic poles 74 and 76 are opposed to each other, i.e., the line of the width of the armature 80 is parallel to the line in the direction in which the magnetic poles 74 and 76 face each other. The armature 80 is shifted to the directions indicated by the arrows B and C in FIG. 3 according to the displacement of the leaf spring 78. Further, a support beam 82 that projects toward the center of the shaft center of the print head 40 is attached to the armature 80, and a printing wire 84 is provided as a printing element at the distal end of the support beam 82.

The length of the printing wire 84 is so set that, when the print head 40 is assembled, the distal end of the wire 84 projects slightly beyond the edge portion of the circular hole 66B, which is formed in the front housing 66. A guide (not shown) for the printing wire 84 is provided in the internal wall of the circular hole 66B of the front housing 66.

A front magnetic unit 86 is located on the internal side of the front frame 64. Although a single front magnetic unit 86 is shown in FIG. 3, actually, the magnetic units 86, whose number is equivalent to the number of the magnetic units 68 that have the same structure and are arranged as in a ring around the internal side of the front frame 64. The magnetic unit 86 includes a yoke plate 88. As well as the coil 72, a coil 90, which is a second coil, is wound around a yoke 88. A groove 64B for storing the coil 90 is formed in the internal wall 64A of the front frame 64.

To the sides of the yoke 88, a pair of magnetic poles 92 and 94 are arranged in parallel to each other with the yoke in between. The magnetic poles 92 and 94 are made of magnetic material, and are extended toward the plate 62 (downward in FIG. 3). These extension portions of the magnetic poles 92 and 94 face each other with a gap between them that corresponds to the thickness of the yoke 88. When the print head 40 is assembled, the magnetic poles 92 and 94 are so arranged that the distal end of the magnetic pole 92 faces the distal end of the magnetic pole 74 with the armature 80 in between, and the distal end of the magnetic pole 94 faces the distal end of the magnetic pole 76 with the armature 80 in between.

With this structure, the line in the direction in which the magnetic poles 92 and 94 face each other crosses at a right angle the line in the longitudinal direction of the armature 80, i.e., it is parallel to the line in the direction of the width of the armature 80. In the magnetic unit 86, the yoke 88 and the magnetic poles 92 and 94 constitute a stator. The yoke 88 and the magnetic poles 92 and 94 may be integrally formed.

Figure 4:
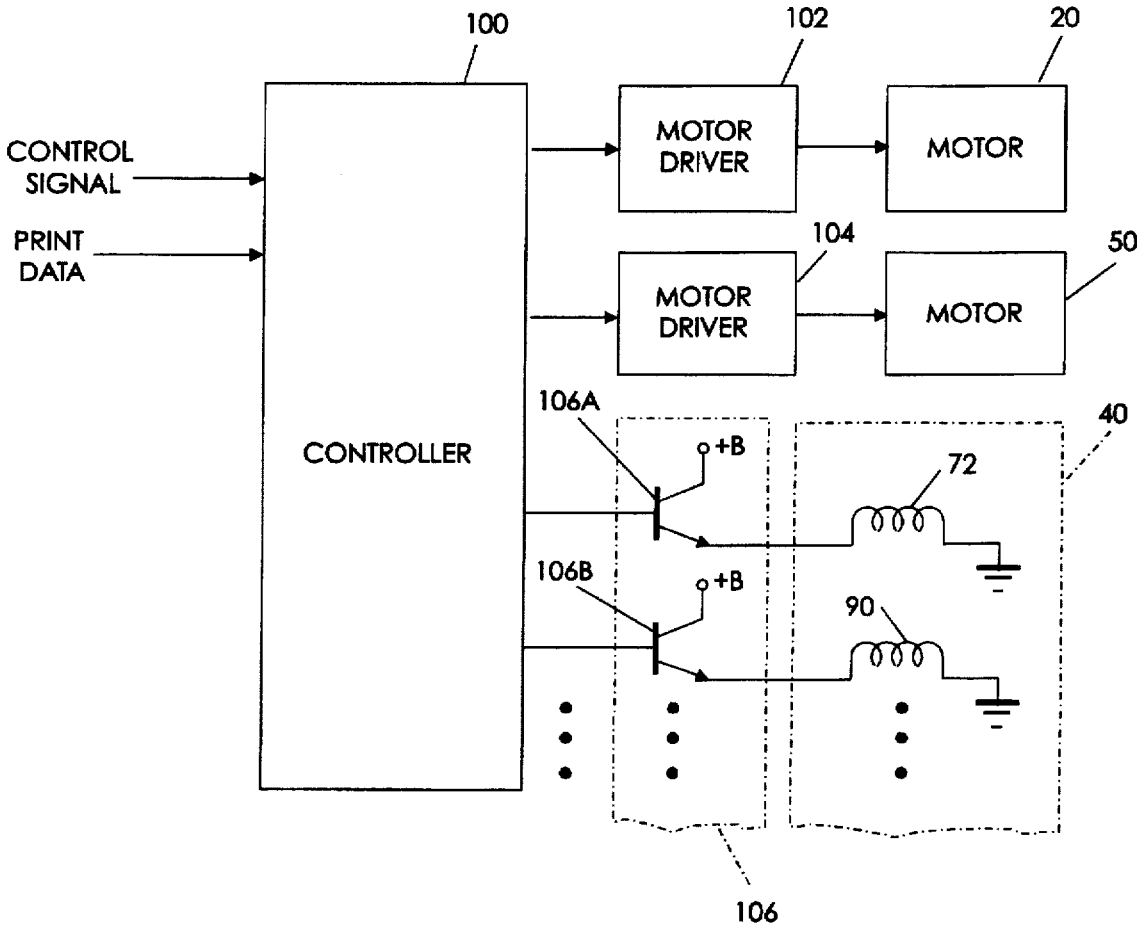
FIG. 4 is a schematic block diagram illustrating the arrangement of a controller in the wire dot-matrix printer.

The control section of the wire dot-matrix printer is arranged as is shown in FIG. 4. A controller 100, which includes a CPU and memory, receives from a host computer control signals, which carry various instructions, such as a print start and print data that represent the matter that is to be printed. Motor drivers 102 and 104 are connected to the controller 100, and motors 20 and 50 are respectively connected to the motor drivers 102 and 104.

A switch circuit 106 is also connected to the controller 100. The switch circuit 106 includes switching elements 106A, 106B, . . . , in a number that is equivalent to the total number of coils in the print head 40. The switching elements are so connected to the controller 100 that they can be turned on or off in consonance with instructions by the controller 100. The switching elements are connected to a power source (not shown) and to the coils of the print head 40. When the switching elements are rendered on by the controller 100, the connected coils are accordingly electrified and excited.

In FIG. 4, the structure of the switch circuit 106 and the connection of the switching elements and the coils are specifically shown. Actually, a transistor, a diode, and other elements are additionally provided so that when the power supply to the coils is halted, a flywheel current flows across the coils.

The coil 72 of each of the rear magnetic units 68 is so connected to the switch circuit 106 that when the coil 72 is excited, a magnetic field occurs in the direction in which the magnetic field of the permanent magnet 70 of the magnetic unit 68 is canceled. The coil 90 of each of the front magnetic units 86 is so located that when the coil 90 is electrified and excited, the direction of a produced magnetic field is opposite to that of the adjacent magnetic unit 86.

The faces of the magnetic poles 92 and 94, of the front magnetic unit 86, that contact the armature 80 constitute a blocking portion that abuts upon the armature 80 when it is shifted in the release direction and restricts the shifting of the armature 80.

Figure 9:
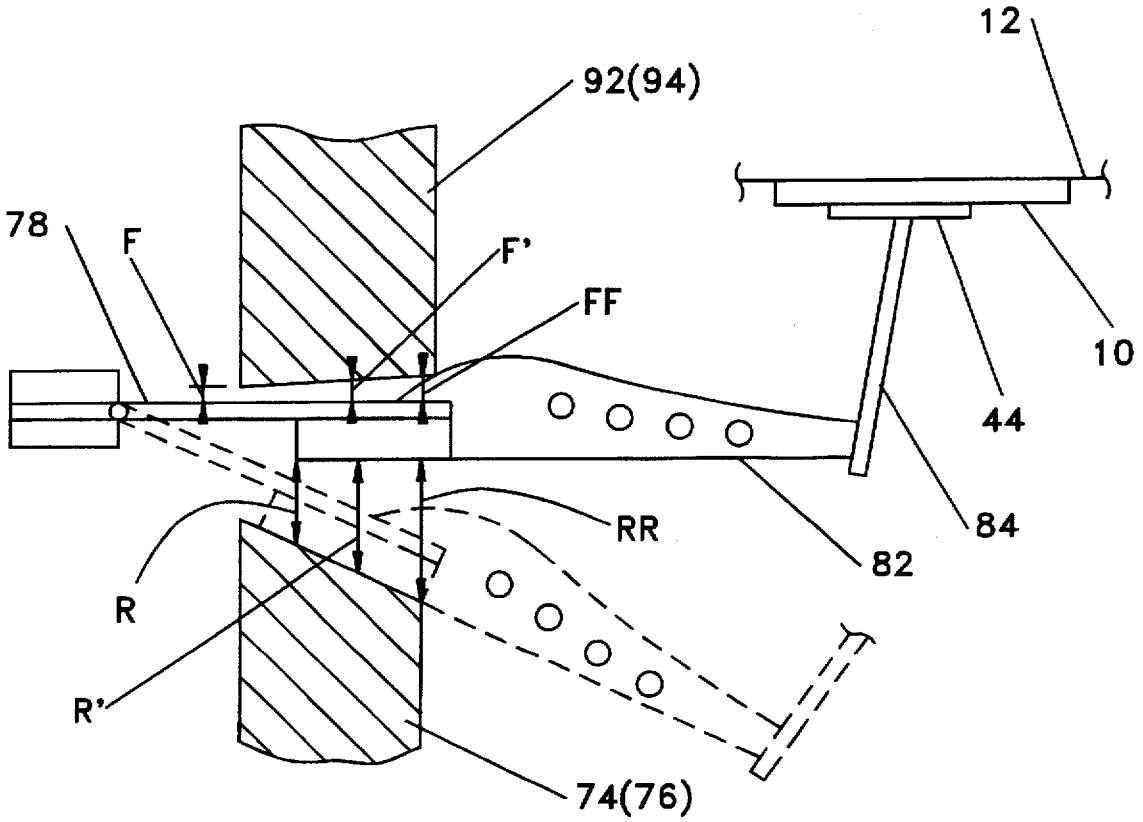
FIG. 9 is an enlarged diagram showing a periphery of the armature for describing a gap between the armature and a magnetic pole.

More specifically, as is shown in FIG. 9, when the leaf spring 78 is located at a neutral position, there is a gap, between the magnetic pole 74 or 76 of the rear magnetic unit 68, where the leaf spring 78 is sufficiently flexed and held while energy is accumulated (see the chain double-dashed line). The faces of the magnetic poles 74 and 76 that contact the armature 80 have a so-called tapered shape where the gap is gradually increased from the base side, which is the support portion for the leaf spring 78, to the distal end, which is the attachment portion for the printing wire 84. As for the inclination of the tapered shape, with R as the narrowest gap, the largest gap RR is approximately 2.7 to 2.8 times wider than gap L.

On the other hand, the gap between the magnetic pole 92 or 94 of the front magnetic unit 86 and the armature 80 is so positioned as to prevent the leaf spring 78 from being flexed. As well as the above case, the faces of the magnetic poles 92 and 94 that contact the armature 80 are tapered. As for the inclination of the tapered shape, with F as the narrowest gap, the largest gap FF is about 3 times as wide.

A ratio of average R' of the gap on the rear magnetic unit 68 side to average F' of the gap on the front magnetic unit 86 side is: R':F'≈1:5.

It is preferable that the gap on the front magnetic unit 86 side be set so that it is approximately ⅓ to ⅔ of a stroke length that is obtained when the armature 80 is freely shifted.

With the gaps being set as described above, when the leaf spring 78 is released from the rear magnetic unit 68 (when the coil 72 and 90 are electrified), the leaf spring 78 abuts upon the magnetic poles 92 and 94 of the front magnetic unit 86 while it is passed through the neutral point and kinetic energy is accumulated. Therefore, by this contact, the leaf spring 78 receives the reaction force and kinetic energy toward the rear magnetic unit 68 (in the return direction) occurs.

Conventionally, elements that contribute to the kinetic energy in the return direction are represented by parameters in the following expression (1), and return time TR' can be calculated by using these parameters.

[Expression 1]

$$TR' = \int_0^{X_R} \left( \frac{8\phi_0^2 l_r^2}{\mu_0 \mu_r A m_r} \cdot \frac{x}{x - x_R} - \frac{K}{m_r} x^2 + \epsilon_p^2 V_1^2 \right)^{-\frac{1}{2}} \quad (1)$$

wherein, $\phi_0$: attracting magnetic flux from permanent magnet 70

$L_r$: length of magnetic paths of magnetic poles 74 and 76 of rear magnetic unit 68

$\mu_0$: permeability in the atmosphere $\mu_r$: permeability of magnetic poles 74 and 76 of rear magnetic unit 68

A: areas of magnetic poles 74 and 76 of the rear magnetic unit 68

$m_r$: equivalent mass at printing wire 84

K: spring constant of leaf spring 78

$\epsilon_p$: impact coefficient from platen 12, etc.

$V_1$: printing wire speed at the impact $X_R$: distance where armature 80 returns from impact position to rear magnetic unit In the above expression, when the spring constant of the leaf spring 78 is determined, almost all coefficients are fixed values, and parameters that are employed to determine the returning time TR' are $\epsilon_p$, $V_1$, and $X_R$. Since parameter $X_R$ is constant when the distal end of the printing wire 84 is fixed to the platen 12, the remaining parameters are $\epsilon_p$ and $V_1$. The value in the term, $\epsilon_p^2 V_1^2$, is extremely small and $\epsilon_p$ is about 0.4 when a sheet that is to be printed is thick.

On the other hand, in this embodiment, since the reaction force that results when the leaf spring 78 abuts upon the magnetic poles 92 and 94 of the front magnetic unit 86 is added to the returning time, the value of the term $\epsilon_p^2 V_1^2$ is changed. That is, the returning time TR is represented by the following expression (2).

[Expression 2]

$$TR = \int_0^{X_R} \left( \frac{8\phi_0^2 l_r^2}{\mu_0 \mu_r A m_r} \cdot \frac{x}{x - x_R} - \frac{K}{m_r} x^2 + \epsilon_B^2 V_1'^2 \right)^{-\frac{1}{2}} \quad (2)$$

wherein, $\epsilon_B$: impact coefficient from platen 12, etc. (including the impact coefficient occurring between armature 80 and the magnetic poles 92 and 94) and $V_1'^2$: printing wire speed at the impact ($V_1'^2 > V_1^2$ due to the attraction of the front magnetic unit 86)

Compared with $\epsilon_p$, $\epsilon_B$ can be a higher value that is close to 1 because of the impact coefficient when the metal members are brought into contact with each other. Thus, the relation $\epsilon_B V_1' >> \epsilon_p V_1$ can be acquired. From this relation, the relation TR<TR' can be obtained. It is apparent from this result that in this embodiment the reaction force, which occurs when the armature 80 is brought into contact with the front magnetic unit 86, greatly affects the returning time.

The processing of the present embodiment will now be described.

When the wire dot-matrix printer of the present invention begins to print the recording medium 10, the controller 100 employs the input print data to determine how the print head 40 is to be shifted and the shift timing for the printing wire 84. The controller 100 then feeds the recording medium 10 and moves the shift block 38 to an initial position to that the print head 40 corresponds to a predetermined portion of the recording medium 10. Then, the controller 100 moves the printing wire 84 according to the determined shift timing as the recording medium 10 is being fed and the shift block is being moved, and thus prints the recording medium 10.

The movement of the printing wire 84 is performed as follows. First, when the printing wire 84 is on standby before it is shifted, the coil 72 of the rear magnetic unit 68 and the coil 90 of the front magnetic unit 86 are not electrified.

Figure 5:
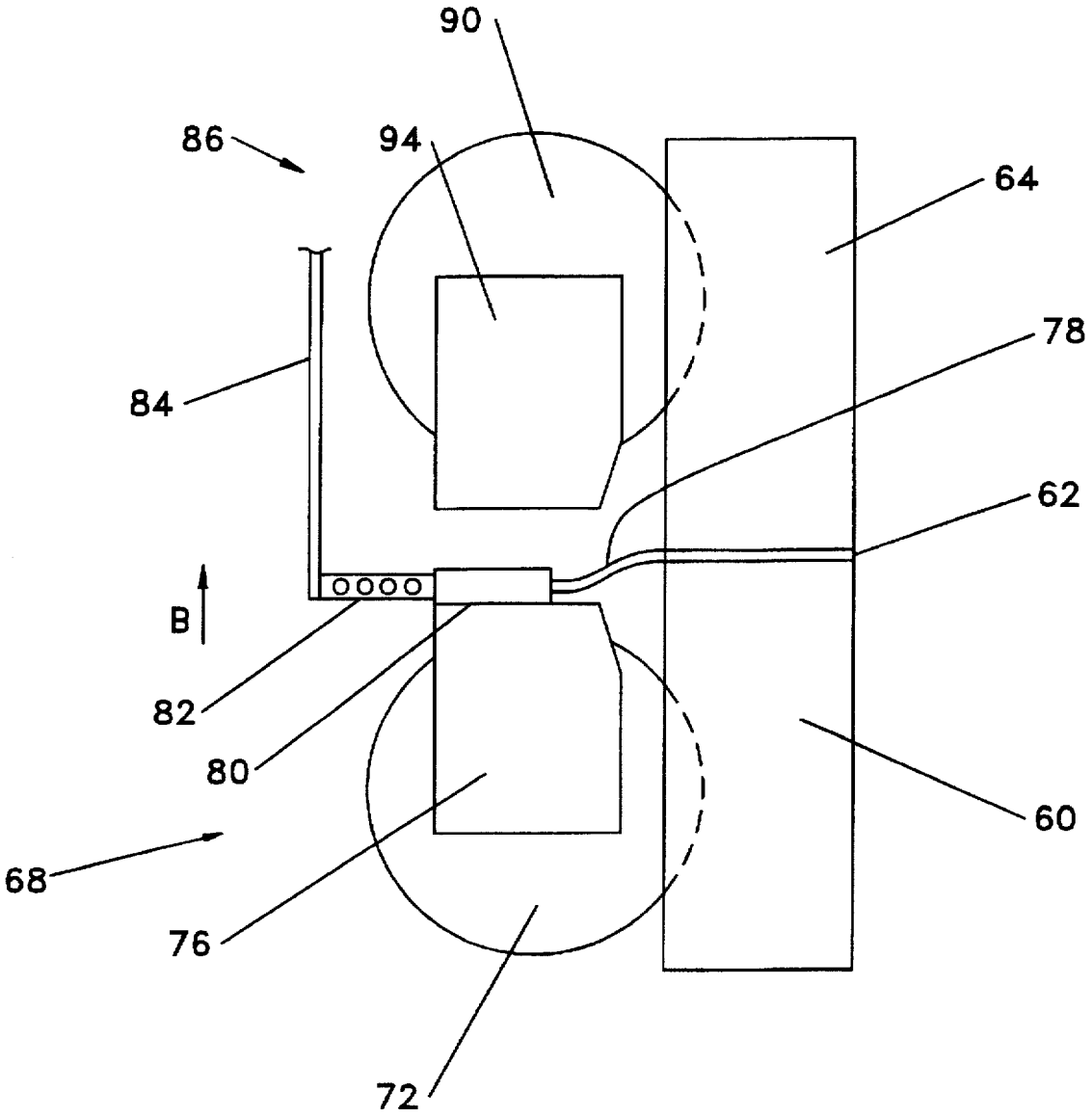
FIG. 5 is a schematic diagram illustrating the armature when it is located at a standby position.

As is described above, in the rear magnetic unit 68 of the print head 40 is the permanent magnet 70. In this standby state, when the magnetic flux that passes through the permanent magnet 70 and the magnetic poles 74 and 76 flows along the width of the armature 80, via the gaps between the distal ends of the magnetic poles 74 and 76 and the armature 80, the attraction force acts on the armature 80. As is shown in FIG. 5, therefore, the armature 80 is attracted to the distal ends of the magnetic poles 74 and 76 against the recovery force of the leaf spring 78 (hereafter the position of the armature 80 at this time is referred to as a "standby position"). The leaf spring 78 at this time is displaced and the recovery force for returning to a neutral position with a displacement of "0" is stored.

Figures 7A, 7B, 7C, 7D, 7E:
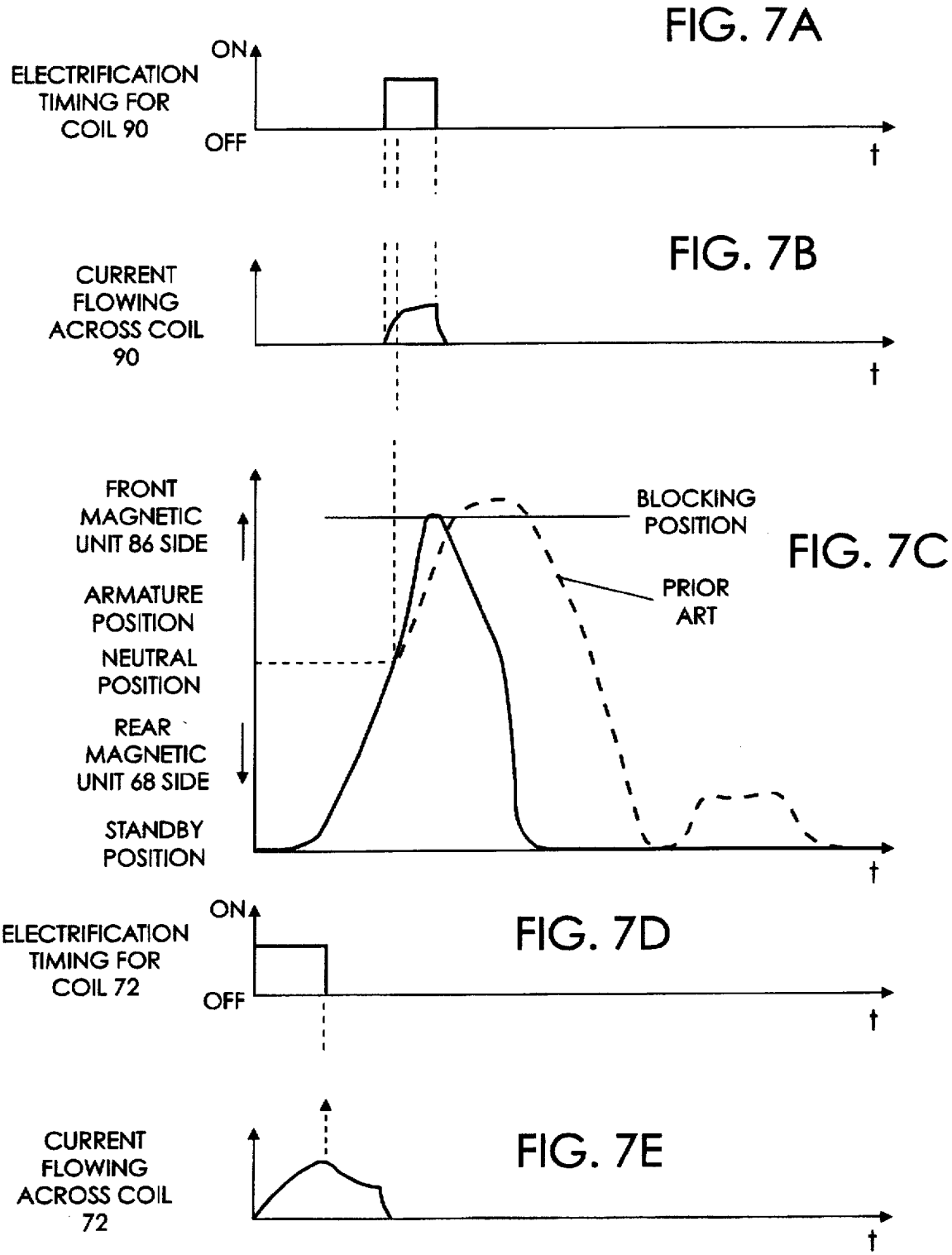
FIG. 7A is a timing chart for the electrification of a coil 90.
FIG. 7B is a timing chart for the change in a current that flows across a coil 90.
FIG. 7C is a timing chart for the change in the position of the armature.
FIG. 7D is a timing chart for the electrification of a coil 72.
FIG. 7E is a timing chart for the change in a current that flows across the coil 72.

When the given printing wire 84 is to be moved, the controller 100 turns on the switching element 106A of the switch circuit 106, and electrifies for a predetermined time the coil 72 of the rear magnetic unit 68 that corresponds to the printing wire 84 (see FIG. 7D). Then, as is shown in FIG. 7E, a current flows across the coil 72, the stator of the rear magnetic unit 68 becomes excited, and a magnetic field that cancels the magnetic field of the permanent magnet 70 occurs. Therefore, the attraction force toward the armature 80 is lost, and the armature 80 and the printing wire 84 are moved by the recovery force, which is stored in the leaf spring 78, in a direction (indicated by the arrow B in FIGS. 3 and 5) in which they are separated from the rear magnetic unit 68, as is shown in FIG. 7C. By the flywheel effect, a current that flows through the coil 72 is gradually reduced after the current supply to the coil 72 is halted, as is shown in FIG. 7E.

The armature 80 passes through the neutral position and is moved nearer the front magnetic unit 86 by inertia. The controller 100 turns on the switching element 106B of the switch circuit 106 a predetermined time before the armature 80 passes through the neutral position, and supplies a current to the coil 90 of the corresponding front magnetic unit 86 for a predetermined time (see FIG. 7A). Then, as is shown in FIG. 7B, a current flows through the coil 90 and the stator of the front magnetic unit 86 becomes excited. When the magnetic flux that has passed through the yoke 88 and the magnetic poles 92 and 94 flows along the width of the armature 80 via the gaps between the distal ends of the magnetic poles 92 and 94 and the armature 80, the attraction force acts on the armature 80. Therefore, as is shown in FIG. 7C, the armature 80 is accelerated and shifted in the direction in which it approaches the front magnetic unit 86.

Figure 6:
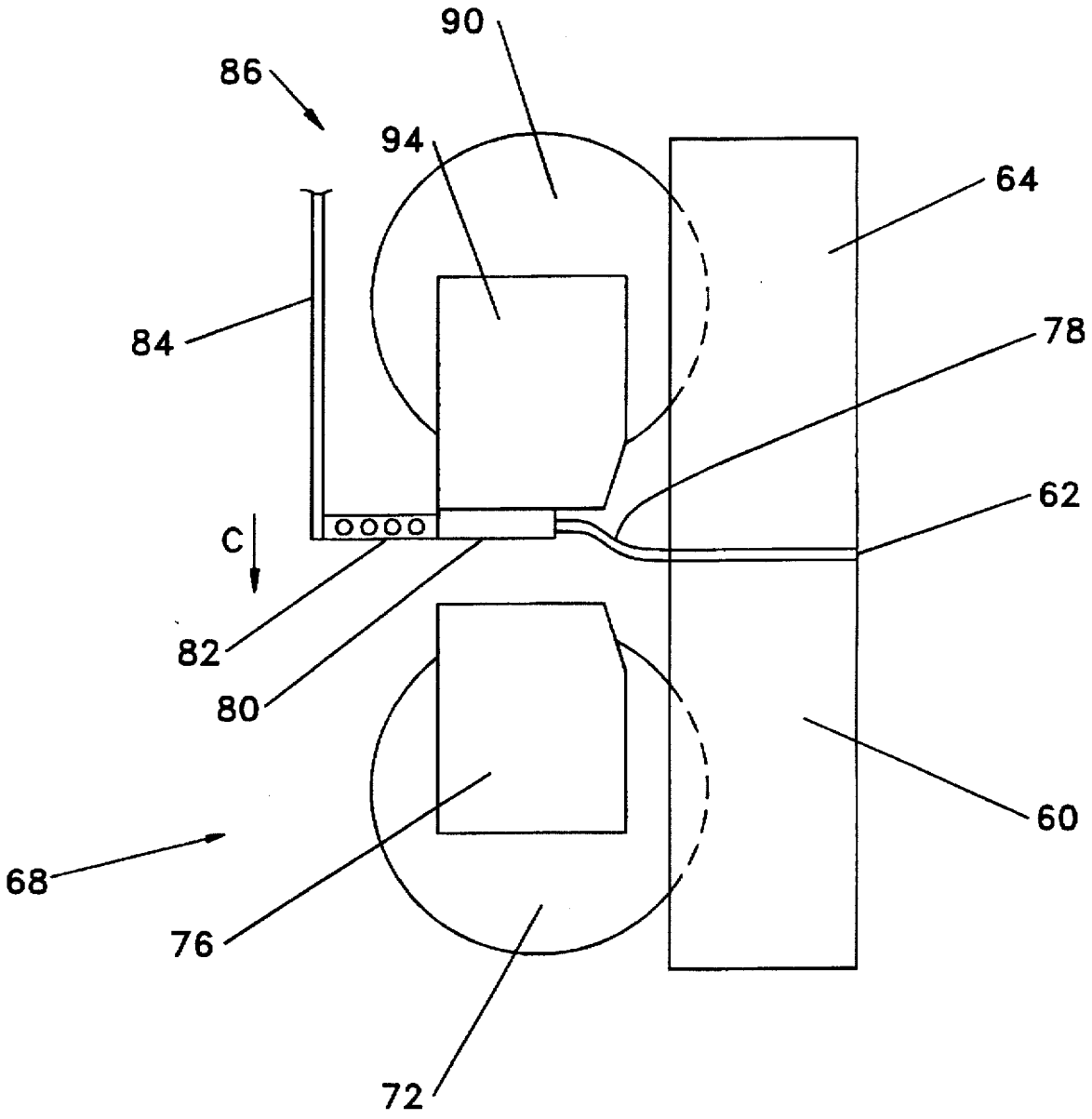
FIG. 6 is a schematic diagram illustrating the armature when it is attracted to a front magnetic unit.

The armature 80 moves continuously until it contacts the distal ends of the magnetic poles 92 and 94 of the front magnetic unit 86 (until the state in FIG. 6 is obtained). The distal end of the printing wire 84 abuts upon the ink ribbon 44 during this travel, and presses against the recording medium 10 through the ink ribbon 44 so as to record dots on the recording medium 10.

When the current supply to the coil 90 begins a predetermined time before the armature 80 passes through the neutral position, the speed of the armature 80 can be greatly increased. However, the timing may be so set that current is supplied in consonance with the armature 80 passing through the neutral position. Compared with the prior art, the increased shifting speed for the armature 80 can be acquired even after the armature 80 has passed through the neutral position.

When the movement of the armature 80 is halted, i.e., when the armature 80 has contacted the magnetic poles 92 and 94, the reaction force due to the contact occurs, and as is shown in FIG. 6, the leaf spring 78 is displaced and stores recovery force for returning to the neutral position where the displacement is "0." The controller 100 turns off the switching element 106B in consonance with the stopping of the armature 80 when it contacts the magnetic poles 92 and 94, and halts the current supply to the coil 90. The armature 80 is then moved by the composite force that is constituted by the reaction force and the recovery force, which has been stored by the leaf spring 78, in the direction in which the armature 80 is separated from the front magnetic unit 86 (in the direction indicated by arrow C in FIGS. 3 and 6), as is shown in FIG. 7C.

This movement of the armature 80 is continued by inertia even after it has passed through the neutral position. Since the excitation of the coil 72 of the rear magnetic unit 68 is halted, the attraction force of the permanent magnet 70 acts on the armature 80 in the vicinity of the neutral position. While the armature 80 is accelerated (see the portion in FIG. 70 where the inclination is increased), the armature 80 is attracted to the magnetic poles 74 and 76 of the rear magnetic unit 68 and is returned to a standby position shown in FIG. 5.

Figure 8:
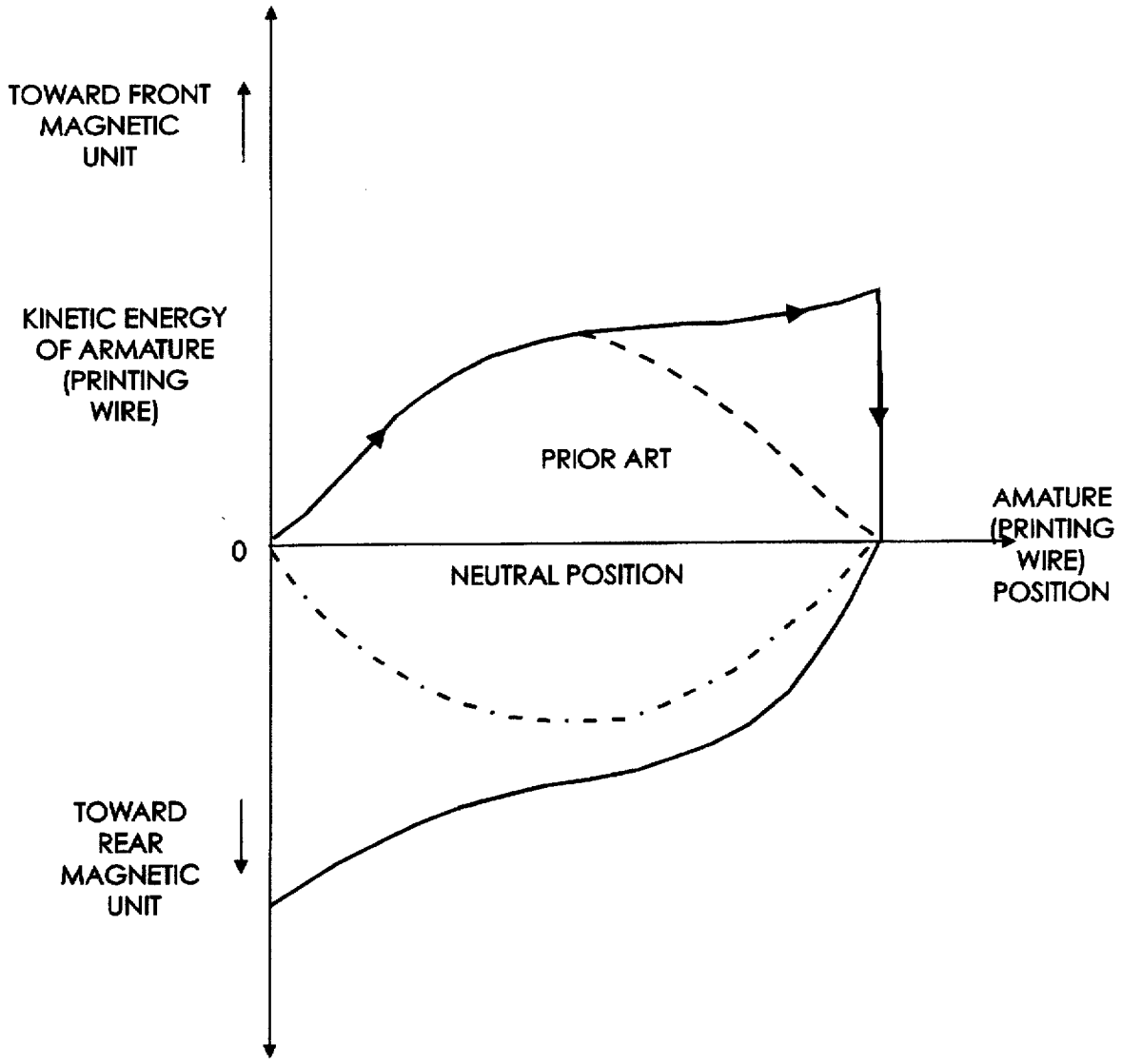
FIG. 8 is a graph showing the change in kinetic energy of the armature and of a printing wire when they are shifted.

Compare the movement of the armature 80 (and the printing wire 84) with that of a conventional print head (indicated by the broken line) while referring to FIG. 70. The movement of the armature 80 that moves from the rear magnetic unit 68 to the front magnetic unit 86 is accelerated by the attraction force that occurs at the coil 90 after the armature 80 has passed through the neutral position. This is apparent for, as is shown in FIG. 8, in the print head 40 of this embodiment the kinetic energy of the armature 80 is increased slightly, instead of being reduced, even after the armature 80 has passed through the neutral position, while the kinetic energy in a conventional armature (indicated by the broken line) is gradually reduced after it has passed through the neutral position.

When the armature 80 shifts from the front magnetic unit 86 to the rear magnetic unit 68 (in the return direction), initial kinetic energy is built up by the composite force that is constituted by the reaction force, which is exerted when the armature 80 contacts the magnetic poles 92 and 94, and the recovery force, which has been stored by the leaf spring 78. Further, the movement of the armature 80 is greatly accelerated by the attraction force of the permanent magnet 70 when no current is supplied to the coil 72. Finally the armature 80 abuts upon the magnetic poles 74 and 76 and is halted. That is, since the initial speed is increased more by the reaction force than is the speed of a conventional armature, the time required for the return is greatly reduced.

Compared with the prior art, since, as is shown in FIG. 7C, it requires only an extremely short time for the printing wire 84 to record dots and return to its standby position from the point at which the armature 80 has begun to move, the printing speed is very high. Since the distance between the standby position and the peak position at which the armature 80 is shifted is large, the shift stroke length of the printing wire 84 is increased.

Since the armature 80 is so designed that it is sandwiched (enclosed) by the rear magnetic unit 68 and the front magnetic unit 86, noise that is produced when the armature 80 contacts the magnetic poles 74 and 76 or 92 and 94 can be shielded, so that the noise that is generated by the print head 40 can be reduced.

(Experiment 1)

(1) If a print head that has a 120 cps printing speed is modified as is described in this embodiment, printing can be performed with no problem at 170 cps for IP printing. In other words, as the result of the experimentation it was found that the printing speed could be increased 45%.

Figure 10:
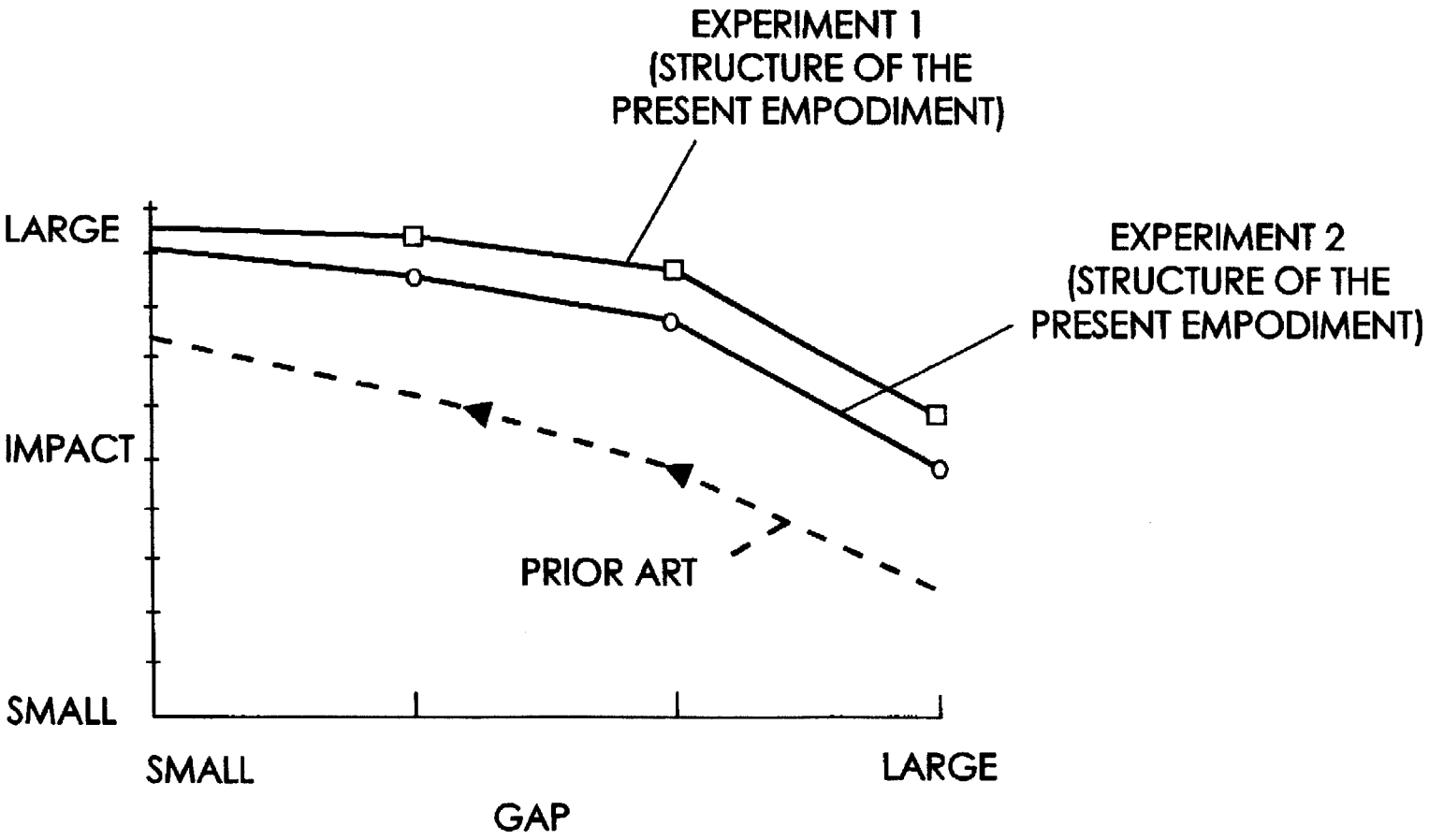
FIG. 10 is a graph showing the head-platen gap-impact force characteristic for the armature and the magnetic pole.

(2) The results obtained by comparing the impact force of a conventional spring charge type with that of the push-pull/blocking type in this embodiment are shown in FIG. 10. Experiment 1 and Experiment 2 show the results for experiments that were performed when the electrified pulse time to the coil 90 was changed.

As is apparent from FIG. 10, although the shift stroke of the armature 80 is limited, the impact force is considerably increased. For this reason, it is assumed that the faces of the magnetic poles 92 and 94 of the front magnetic unit 86 that are opposite to the armature 80 are tapered. Because of the tapered shape, the base side of the armature 80 contacts the magnetic poles 92 and 94 first and then the distal end of the armature 80 that is attached to the printing wire 84 contacts them. Thus, by means of a so-called snapping action, kinetic energy is accumulated at the distal end. The concentration of the kinetic energy provides the increase in the impact force, and enables the simultaneous printing of 10 pages.

Figure 11:
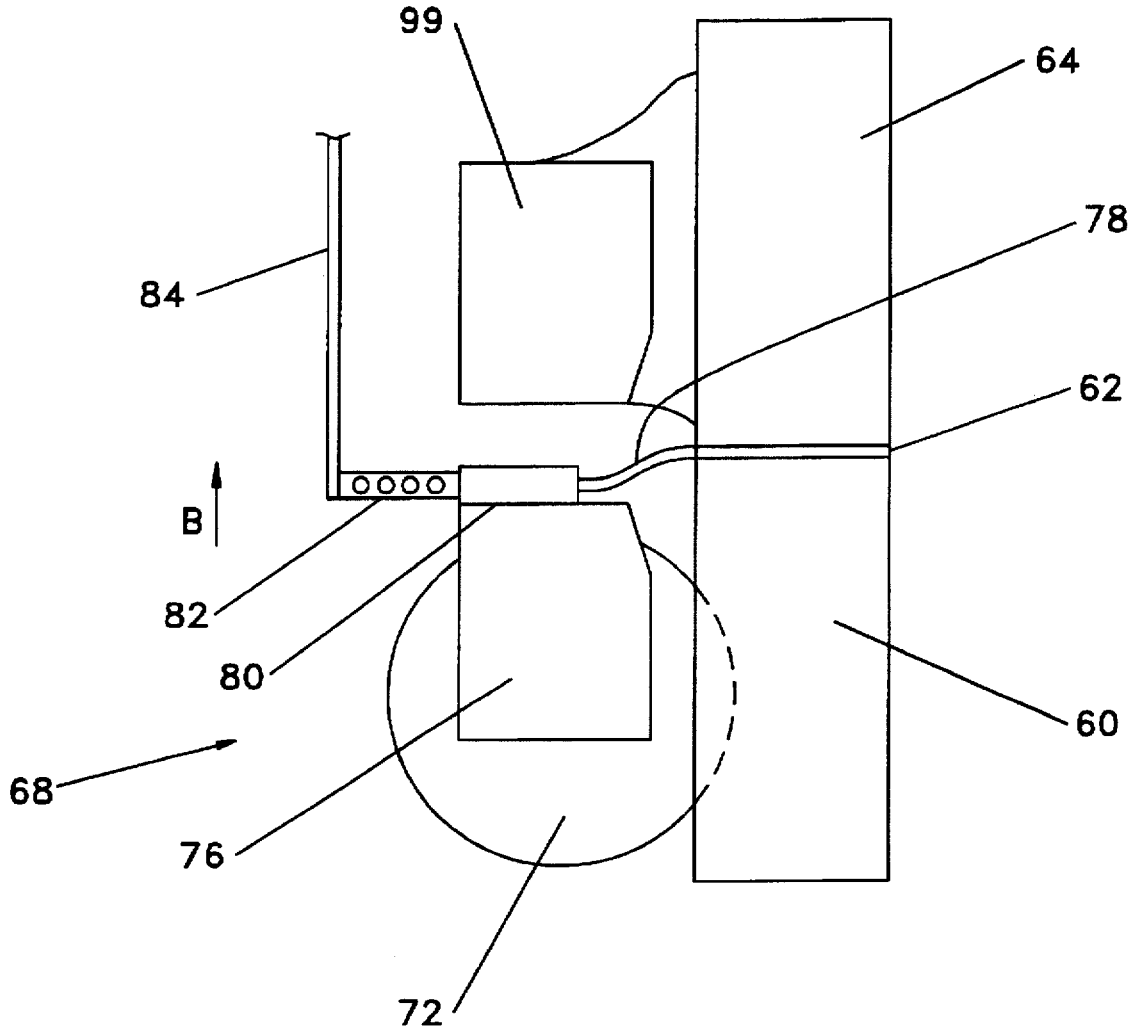
FIG. 11 is a schematic diagram illustrating a print actuator according to a modification of the present invention (where a blocking member is employed).

Although in this embodiment, the front magnetic unit 86 is provided in addition to the rear magnetic unit 68, and the magnetic poles 92 and 94 of the front magnetic unit 86 are employed as blocking members, the front magnetic unit 86 is employed to increase the speed in one direction. To increase the speed only in the return direction, which is the purpose of the present invention, the structure shown in FIG. 11 may be employed where only a blocking member 99 is located at a predetermined position. Naturally, the speed in one direction is lower than that of the embodiment, but through experimentation it was found that there was an increase in speed of 25% compared with that of a conventional structure (where no blocking member is provided).

In the above case, when the blocking member 99 is so provided as to cover the upper area of the armature 80, such a structure is effective for shielding acoustic noise.

In addition, according to the present embodiment, the flat platen 12 is employed and the recording medium 10 is mounted thereon, so that while the recording medium 10 is being shifted in a sub-scanning direction, the print head 40 is moved in the main scanning direction. However, a platen may be set for a narrow width (print width in one main scanning), so that for the main scanning only the print head 40 is shifted in the longitudinal direction of the platen, while for the sub scanning, the platen and the print head 40 are moved at the same time or the recording medium 10 is shifted.

As is described above, a print actuator according to the present invention can considerably increase the printing speed while it maintains an adequate impact force and a shift stroke length.

What is claimed is:

1. A print actuator to perform print cycles comprising:

an armature arranged at one end of an elastic member that is supported rigidly at the other end and establishes a neutral position when no forces are acting;

a print element attached at the end of the armature away from said elastic member;

a first electromagnet mounted to one side of the armature;

a permanent magnet mounted adjacent the first electromagnet which in the absence of other forces attracts the armature from the neutral position in a reverse stroke direction;

a second electromagnet mounted to the opposite side of the armature from said first electromagnet and positioned to be struck by the armature when the elastic member is flexed in the forward stroke direction toward said second electromagnet; and a drive circuit having means for energizing the first electromagnet at the start of a print cycle to repel said armature and counteract the permanent magnet prior to the armature moving beyond the neutral position and for energizing the second electromagnet to attract the armature as the armature approaches the neutral position and until contact with said second electromagnet whereby a tightly controlled print cycle is achieved through push and pull by coordinated operation of the first and second electromagnets on the forward stroke and rebound from the second electromagnet reinforced by pull from the permanent magnet on the return stroke.

* * * * *